US007652580B2

(12) United States Patent
Eisenhauer et al.

(10) Patent No.: US 7,652,580 B2
(45) Date of Patent: Jan. 26, 2010

(54) HIT DETECTION SENSOR MODULE FOR BATTLEFIELD SIMULATIONS

(75) Inventors: Joachim Eisenhauer, Bremen (DE); Klaus Wendt, Sottrum (DE)

(73) Assignee: Rheinmetall Defence Electronics GmbH, Bremen (DE)

( * ) Notice: Subject to any disclaimer, the term of this patent is extended or adjusted under 35 U.S.C. 154(b) by 0 days.

(21) Appl. No.: 10/968,465

(22) Filed: Oct. 20, 2004

(65) Prior Publication Data

US 2006/0088801 A1 Apr. 27, 2006

(30) Foreign Application Priority Data

Oct. 8, 2004 (DE) ..... 10 2004 049 382

(51) Int. Cl.
*G08B 21/00* (2006.01)

(52) U.S. Cl. ..... 340/573.1; 340/825.57; 340/568.1; 340/539.21

(58) Field of Classification Search ..... 340/573.1, 340/447, 825.57, 825.69, 552, 568.1, 825.72, 340/515, 3.1, 538.15, 310.16, 539.1, 539.21
See application file for complete search history.

(56) References Cited

U.S. PATENT DOCUMENTS

| | | | | |
|---|---|---|---|---|
| 4,545,583 | A | 10/1985 | Pearman et al. | |
| 4,744,761 | A * | 5/1988 | Doerfel et al. | 434/13 |
| 4,899,039 | A | 2/1990 | Taylor et al. | |
| 5,426,295 | A * | 6/1995 | Parikh et al. | 250/227.11 |
| 5,530,446 | A * | 6/1996 | Filipek | 342/13 |
| 5,788,500 | A * | 8/1998 | Gerber | 434/22 |
| 5,913,727 | A * | 6/1999 | Ahdoot | 463/39 |
| 6,174,169 | B1 * | 1/2001 | Gerber | 434/11 |
| 6,302,796 | B1 * | 10/2001 | Lebensfeld et al. | 463/51 |
| 6,663,391 | B1 * | 12/2003 | Otowa | 434/16 |
| 6,755,653 | B2 * | 6/2004 | Varshneya | 434/22 |
| 7,046,151 | B2 * | 5/2006 | Dundon | 340/573.1 |
| 2004/0021565 | A1 * | 2/2004 | Rechsteiner et al. | 340/539.1 |
| 2004/0121292 | A1 * | 6/2004 | Chung et al. | 434/11 |
| 2005/0212912 | A1 * | 9/2005 | Huster | 348/155 |

FOREIGN PATENT DOCUMENTS

| | | |
|---|---|---|
| DE | 19 42 840 | 4/1971 |
| DE | 32 01 925 | 8/1983 |
| DE | 92 01 171 | 9/1992 |
| DE | 203 18 427 | 8/2004 |
| EP | 0 836 069 | 4/1998 |
| EP | 0 836069 | 4/1998 |
| EP | 0 945 697 | 9/1999 |
| GB | 2 216 813 | 10/1989 |

* cited by examiner

*Primary Examiner*—Daniel Previl
(74) *Attorney, Agent, or Firm*—Venable LLP; Michael A. Sartori; Steven J. Schwarz

(57) ABSTRACT

A sensor module detects light beam hits on a participant during battlefield simulations. The sensor module includes an infrared sensor for sensing infrared light and generating signals based on the sensed infrared light; a short-range radio transmitter associated with the infrared sensor; an electrical voltage source for supplying electrical capacity to the sensor module; and a device for attaching the sensor module to a participant.

18 Claims, 1 Drawing Sheet

HIT DETECTION SENSOR MODULE FOR BATTLEFIELD SIMULATIONS

CROSS-REFERENCE TO RELATED APPLICATION

This application claims the priority of German Patent Application No. 10 2004 049 382.0 entitled "Sensormodul zur Treffererfassung für Gefechtsfeldsimulationen", filed Oct. 8, 2004, which is incorporated herein by reference.

FIELD OF THE INVENTION

The invention relates to a sensor module for detecting hits during battlefield simulations, as well as the use of the sensor module for a battlefield simulation.

BACKGROUND OF THE INVENTION

As known in the art, combat simulators may be used in combat training centers and for training firing with directly aimed weapons. During the process, information relating to the person firing the shot, the fired shot, the type of weapon and the ammunition used is transferred via an aimed and coded infrared laser beam onto the target. According to this known simulator, the participant who represents a potential target is provided with several detectors or sensors distributed and attached at different locations on the participant. The several distributed sensors detect the impinging laser beam and are wire-connected to an electronic evaluation device, the so-called participant unit that is carried by each participant. The sensor distance and position are selected, in dependence on the diameter of the impinging laser beam, so as to advantageously detect the point at which the beam impinges on the target and thus obtain information on the real-time effect of the weapon. The participant unit contains an evaluation system that evaluates the real-time effect of the hit on the basis of a stored vulnerability model. The participant unit is additionally provided with a radio-controlled system which can establish radio contact with the central training control to provide the hit report.

The sensors or wire connections on the sensors are frequently damaged during the operation of the known sensor equipment in the military environment, thus resulting in a functional reduction or failure of the complete sensor system and therefore also the training participant. The identification of a defective sensor or a defective wire connection is difficult and involved due to the method of wiring in a parallel series. Compared to the value of the equipment, the repair costs are thus extremely high.

SUMMARY OF THE INVENTION

It is therefore an object of the present invention to create a sensor module for detecting hits during battlefield simulations which does not have the above-described disadvantages.

This object is solved according to the invention with a sensor module provided with an infrared sensor, a short-range radio transmitter, an electrical voltage source and means for attaching the module to a participant.

A "participant" in this case is generally referred to as a potential target for a battlefield simulations, meaning a participant can be a person, a vehicle or even a building.

Individual sensor modules of a participant can be linked to each other and to the participant unit via short-range radio communication in a radio network. The radio network may be based on the blue-tooth technology and have a range of up to 10 meters in an advantageous embodiment of the invention.

The infrared sensor of the sensor module is thus connected wireless via a radio network to the participant unit, thus reducing damage frequency since there are no wires which could break. Furthermore, it is not necessary to adapt the sensor modules to a specific participant. This feature permits a standardized production and simplifies warehouse storage. As a result, costs are reduced during the production and maintenance of the sensor modules. In addition, trouble shooting and error detection in the sensor modules are also simplified.

Added to the above features are the advantages of an easier attachment and removal of the sensor modules from a participant. According to an exemplary embodiment of the invention, sensor modules may be provided to new targets or new-type targets in a simplified manner. For example, the means for attaching the sensor module may include a flexible attachment of sensor modules with variable vulnerability modules having different resolution.

Another particularly advantageous embodiment of the sensor module additionally may include a solar cell and a storage battery that can be charged up with this solar cell. The storage battery is thus charged in dependence on the light conditions so that its discharge is clearly buffered.

The improved energy supply of the above embodiment makes it possible to integrate a signal amplifier into the sensor module in order to amplify signals from the infrared sensor without reducing the service time as a result of increased energy consumption. The sensitivity of the sensor module is increased as a result of the signal amplifier, so that the laser energy that triggers a signal can be reduced. The laser transmitting capacities can thus be reduced to a value where any type of danger to the eyes of participants is ruled out. Another advantage of the signal amplifier is the fact that filters can be installed for filtering out interfering external light, e.g. sunlight.

The infrared sensor for an embodiment of the sensor module preferably has an effective aperture angle of more than 90° and preferably approximately 120°. As a result of the large aperture angle and the higher sensitivity of the sensor, it is possible to record and evaluate even scattered light from uneven areas on the target. Since the bundled laser beam has a smaller diameter with higher energy density at close range (distances of less than 5 to 10 meters), it can happen that the sensors are not illuminated directly, even with direct body hits. With known sensors, a delay in illumination or a sensor that does not fully illuminate or illuminate at all leads to unrealistic training. The infrared sensor of the sensor module according to the invention records and evaluates even scattered light. Consequently, the sensor module according to the invention enables a target to be hit in a far region and still illuminate fully. Thus, the sensor module according to the invention is designed so that a target can be hit from all sides.

BRIEF DESCRIPTION OF THE DRAWINGS

Further details and advantages of the invention follow from the exemplary embodiment described below, which is explained with the aid of the following Figures.

DETAILED DESCRIPTION OF THE INVENTION

Figure 1:
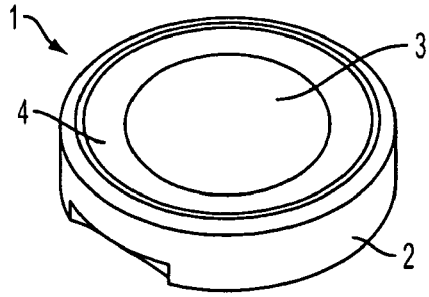
FIG. 1 is a perspective view from above of an embodiment of a sensor module according to the invention.
Figure 2:
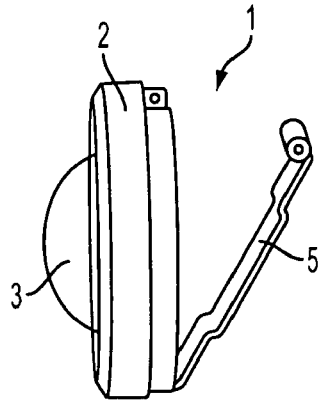
FIG. 2 is a side view from of the sensor module illustrated in FIG. 1.

The sensor module 1 includes a housing 2, which-may be in the shape of a flat cylinder. Housing 2 may be closed in the back. An approximately semi-spherical infrared sensor 3 is mounted in a circular opening in the front of housing 2. The receiving surface of infrared sensor 3 projects in the form of a spherical cap from the housing 2 and thus, covers a spatial angle of more than 90°, preferably approximately 120°. A ring-shaped solar cell 4 is arranged on the outside around the sensor 3 and charges up a storage battery arranged on the inside of the housing 2. The storage battery functions as an electrical voltage source and supplies the sensor module 1 with the necessary electrical capacity.

Furthermore disposed inside the housing 2 is a short-range radio transmitter which transmits with low transmitting capacity at high frequencies, preferably in the GHz range. The short-range radio transmitter is preferably designed to operate on the basis of the blue-tooth technology. Also disposed inside the housing 2 is a signal amplifier for amplifying the signals generated by the infrared sensor 3 before they are transmitted by the short-range transmitter to a participant unit 7. Optical filters are preferably also provided, which function to filter out interfering external light, e.g. sunlight, and thus improve the signal quality. Means for attaching the sensor module 1 to the participant are arranged on the back of the housing. For this example, the attachment means consist of a clip 5 which is attached to the back and can be used to simply clamp the sensor module 1 to the participant for the battlefield simulation.

Figure 3:
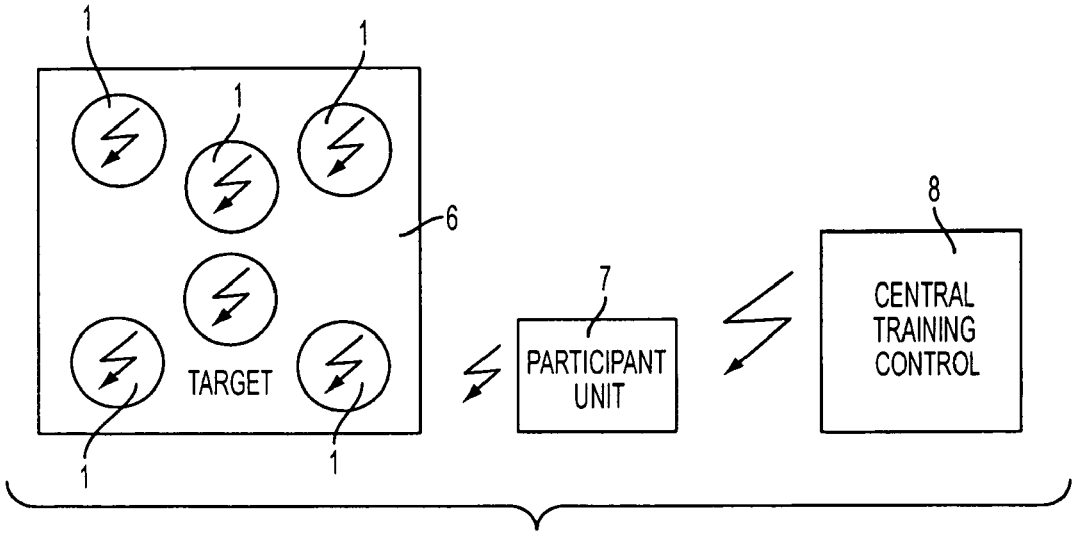
FIG. 3 is a block diagram schematically showing the use of a sensor module according to an embodiment of the invention during a battlefield simulation.

As shown schematically in FIG. 3, the individual sensor modules 1 used for the battlefield simulation are positioned precisely at the sensitive locations on the participant 6, meaning a person, a vehicle or even a building, depending on the vulnerability model of the potential target. Each participant 6 additionally carries the participant unit 7, comprising an evaluation system and a radio communication system as essential components. The participant unit receives, on the one hand, the signals from the sensor module 1 attached to participant 6 and, on the other hand, can establish radio communication with the central training control 8. The individual sensor modules 1 and the participant unit 7 jointly form a radio network on the participant 6. The radio network, for example, may be configured as a WLAN network. If the simulation participant is a soldier, an embodiment of the sensor module may incorporate a simulation weapon into the radio network.

The invention has been described in detail with respect to exemplary embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

We claim:

1. A battlefield simulation apparatus, comprising:

a participant unit carried by a participant, the participant unit including an evaluation unit; and a hit detection sensor module carried by the participant for detecting hits by a light beam on the participant during battlefield simulations, said hit detection module comprising:

a housing having a front and a back;

an infrared sensor mounted in an opening in the front of the housing for sensing infrared light and generating signals based on the sensed infrared light;

a short-range radio transmitter disposed inside the housing and associated with the infrared sensor, said short-range radio transmitter transmitting signals outside the housing from the infrared sensor to the evaluation unit of the participant unit, wherein the infrared sensor is connected wireless via a radio network to the evaluation unit of the participant unit;

an electrical voltage source for supplying electrical capacity to the hit detection sensor module, wherein the electrical voltage source is disposed in the housing and includes a solar cell and a storage battery, wherein the storage battery is chargeable by the solar cell; and means for attaching the hit detection sensor module to the participant.

2. The battlefield simulation apparatus according to claim 1, wherein the hit detection sensor module further comprises a signal amplifier for amplifying signals received from the infrared sensor before the signals are transmitted by the short-range transmitter to the participant unit.

3. The battlefield simulation apparatus according to claim 2, wherein the hit detection sensor module further comprises a filter for filtering out interfering external light, said filter being installed in the signal amplifier.

4. The battlefield simulation apparatus according to claim 2, wherein the short-range radio transmitter is a transmitter based on the blue tooth technology.

5. The battlefield simulation apparatus according to claim 2, wherein said infrared sensor includes a receiving surface having a cap so that the infrared sensor covers a spatial angle of more than approximately 90°.

6. The battlefield simulation apparatus according to claim 5, wherein said cap is partially spherical.

7. The battlefield simulation apparatus according to claim 2, wherein said infrared sensor includes a receiving surface having a cap so that the infrared sensor covers a spatial angle of more than approximately 120°.

8. The battlefield simulation apparatus according to claim 7, wherein said cap is partially spherical.

9. The use of a battlefield simulation apparatus according to claim 2 for detecting hits on the participant in a battlefield simulation.

10. The battlefield simulation apparatus according to claim 1, wherein the hit detection sensor module further comprises an optical filter for filtering out interfering external light from the infrared light to improve the generated signal.

11. The battlefield simulation apparatus according to claim 1, wherein the hit detection sensor module further comprises an optical filter for filtering out interfering external light from the infrared light to improve the generated signal.

12. The battlefield simulation apparatus according to claim 1, wherein the short-range radio transmitter is a transmitter based on the blue tooth technology.

13. The battlefield simulation apparatus according to claim 1, wherein said infrared sensor includes a receiving surface having a cap so that the infrared sensor covers a spatial angle of more than approximately 90°.

14. The battlefield simulation apparatus according to claim 13, wherein said cap is partially spherical.

15. The battlefield simulation apparatus according to claim 1, wherein said infrared sensor includes a receiving surface having a cap so that the infrared sensor covers a spatial angle of more than approximately 120°.

16. The use of a battlefield simulation apparatus according to claim 1 for detecting hits on the participant in a battlefield simulation.

17. The use according to claim 16, wherein a plurality of individual sensor modules are attached to a participant and are associated with the participant unit, said individual sensor modules and participant unit being linked to each other via the radio network.

18. The battlefield simulation apparatus according to claim 1, wherein said infrared sensor includes a receiving surface having a partially spherical cap, and the solar cell is ring-shaped and located around the cap.

* * * * *